United States Patent [19]

Ohkawa et al.

[11] 4,234,771

[45] Nov. 18, 1980

[54] VACUUM SWITCH

[75] Inventors: Mikio Ohkawa, Machida; Nobuo Kawashima, Tokyo, both of Japan

[73] Assignee: Tokyo Shibaura Denki Kabushiki Kaisha, Kanagawa, Japan

[21] Appl. No.: 857,458

[22] Filed: Dec. 5, 1977

[30] Foreign Application Priority Data

Dec. 9, 1976 [JP] Japan ..... 51-147164
Dec. 9, 1976 [JP] Japan ..... 51-164123[U]
Feb. 14, 1977 [JP] Japan ..... 52-14208

[51] Int. Cl.[2] ..... H01H 33/66
[52] U.S. Cl. ..... 200/144 B
[58] Field of Search ..... 200/144 B

[56] References Cited

U.S. PATENT DOCUMENTS 3,914,568 10/1975 Crouch et al. ..... 200/144 B
4,081,640 3/1978 Rich ..... 200/144 B

FOREIGN PATENT DOCUMENTS 571959 1/1958 Italy ..... 200/144 B

*Primary Examiner*—Robert S. Macon
*Attorney, Agent, or Firm*—Stevens, Davis, Miller & Mosher

[57] ABSTRACT

In a vacuum vessel having a vacuum vessel defined by an insulating cylinder and end plates, relatively movable first and second contacts and a bellows, there are provided a first metal plate having a reentrant portion, a second metal plate also having a reentrant portion, and an operating mechanism for separating the contacts which operates such that both contacts are positioned in the reentrant portion of the first metal plate at the time of current interruption and one of the contacts is moved into the reentrant portion of the second metal plate after the current interruption.

6 Claims, 12 Drawing Figures

VACUUM SWITCH

BACKGROUND OF THE INVENTION

This invention relates to a vacuum switch having high current interrupting capability and high insulating strength after current interruption.

In FIG. 1, there is shown a conventional vacuum switch which comprises a vacuum vessel defined by an insulating cylinder 1 made of an inorganic material such as ceramics or glass and end plates 2 and 2'. In the vessel there are disposed a stationary contact 4 secured to the end of a stationary rod 3 and a movable contact 6 secured to the end of a movable rod 5, and disposed to oppose the stationary contact, and a metal shield 8 is provided around the contacts to condense metal vapor generated by electric arc at the time of current interruption. A metal bellows 7 is further provided for opening and closing the contacts 4 and 6 while maintaining airtightness. Such a vacuum switch can interrupt the current by separating slightly the contacts from each other by moving the movable rod 5 outwardly of the vacuum vessel and can maintain sufficient insulating strength under the vacuum after the current interruption.

However, recently it has been required to provide a vacuum switch to be used with high voltage and large current and it has been found that such a conventional vacuum switch shown in FIG. 1 can no longer be used for electric circuits operating at a voltage higher than a certain limit because of the lowering of the insulating strength between the contacts after the current interruption, this lowering of the insulating strength being based on the fact that the surface of the contacts are roughened by the arc generated therebetween and a number of small projections are formed on the surfaces thereby extremely strengthening the local electric field causing discharge.

In certain designs, annular metal fittings are used, each of which is welded or soldered to the end plate at its one end and at the other end secured airtightly to the end portion of the insulating cylinder. In such structure, the outer diameter of the annular fitting is substantially equal to the maximum diameter of the vacuum vessel, and to this fitting is applied the same voltage as that applied to the stationary contact of a vacuum switch. Therefore, it is required to make the interphase distance of a three phase circuit breaker large and the insulating distance from the ground in the case where the vacuum switch is accomodated in a cubicle or a tank, which finally leads to the enlargement of the size of the switching apparatus as a whole.

Furthermore, after the fabrication of the vacuum vessel by means of soldering or welding, degassification of the interior of the vessel should be made through an evacuating and seal-off tube attached to one of the end plates by heating the vessel. The top end of the seal-off tube is connected to an evacuation device, and the seal-off tube is cut and sealed off at a suitable portion near the end plate after completion of the degassification. However, since the cut seal-off tube still projects from the end plate, it is obstructive for the conveyance or installation of the vacuum vessel and attention must be paid so as not to damage the tube.

SUMMARY OF THE INVENTION

Accordingly, a primary object of this invention is to eliminate the defects mentioned above.

Another object of this invention is to provide a vacuum switch having high interrupting capability and high insulating strength in spite of the fact that the surfaces of the stationary and movable contacts become rough after the current interruption.

Still another object of this invention is to provide a vacuum switch having high external insulating strength.

A further object of this invention is to provide a vacuum switch having an improved evacuating and seal-off tube disposed in such portion of the end plate that the tube would not project to the outside of the vacuum vessel.

According to this invention, there is provided a vacuum switch of the type comprising a vacuum vessel defined by an insulating cylinder and end plates sealed to both ends of the insulating cylinder, relatively movable first and second contacts, and a bellows attached to one of the end plates, characterized in that there are provided a first metal plate having a reentrant portion, a second metal plate also having a reentrant portion, and an operating mechanism for separating both contacts which operates such that the both contacts are positioned in the reentrant portion of the first metal plate at the time of current interruption and one of the contacts is moved into the reentrant portion of the second metal plate for increasing the insulating distance after the current interruption.

BRIEF DESCRIPTION OF THE DRAWINGS

The other objects and advantages of the present invention will be more readily understood from the following detailed description of preferred embodiments thereof taken in conjunction with the accompanying drawings in which like reference numerals are applied to the like parts in various views, in which.

DESCRIPTION OF THE PREFERRED EMBODIMENTS

Figure 1:
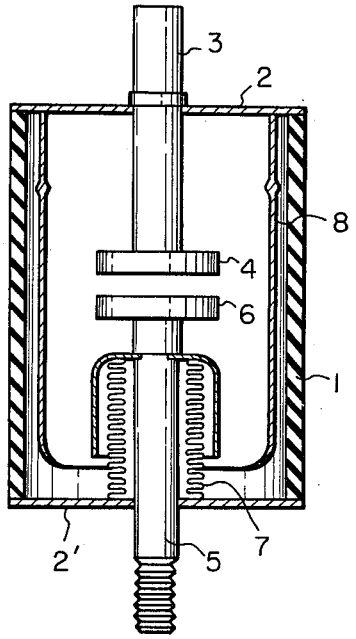
FIG. 1 PRIOR ART
FIG. 1 is a vertical cross-sectional view showing conventional vacuum switch.
Figure 2:
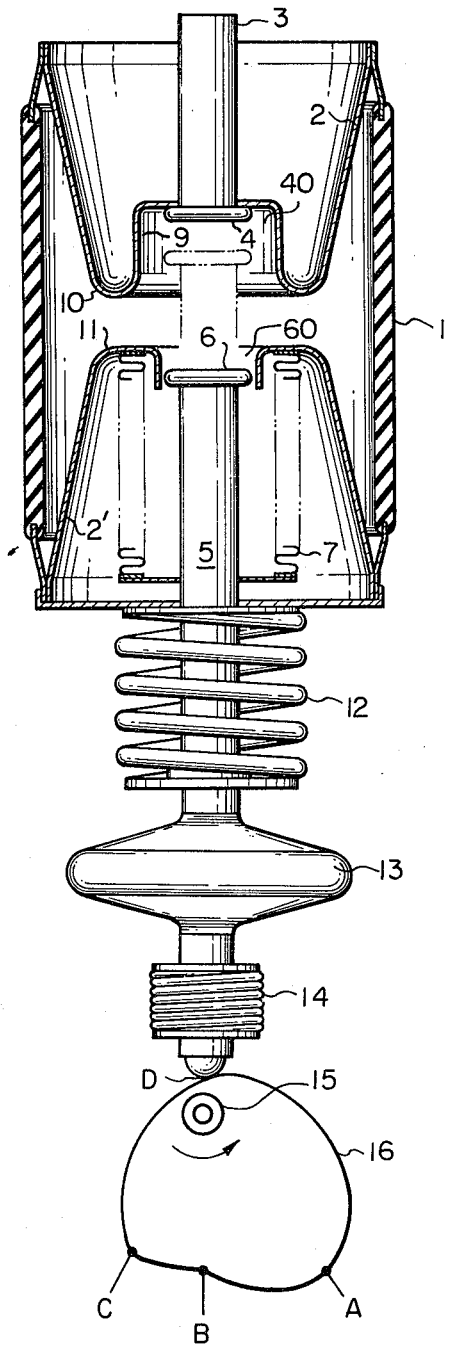
FIG. 2 is a vertical cross-sectional view showing one embodiment of a vacuum switch according to the present invention.

In a vacuum switch shown in FIG. 2, the end plates 2 and 2' of the vacuum vessel are mounted to extend inwardly towards the contacts 4 and 6 and further folded back outwardly to form projections 10 and 11 and reentrant portions 40 and 60. A hole is provided for the reentrant portion 60 of the end plate 2' so that the movable rod 5 may be moved towards or away from the stationary contact 4 through the hole.

The vacuum switch is constructed such that for opening the circuit, the movable contact 6 is firstly moved to an "interrupting opened position" as shown by dot and dash lines in FIG. 2, in the reentrant portion 40 of the end plate 2 and then moved to a "disconnecting opened position" as shown by solid line in the reentrant portion 60 of the end plate 2' which is electrically connected to the movable contact 6. The bellows 7 has one end mounted on the movable rod 5 and the other end secured to the projected portion 11 of the end plate 2'.

In the illustrated embodiment of FIG. 2, the movable rod 5 is surrounded by an opening spring 12, and an insulating coupler 13 and a compression spring 14 are attached successively to the movable rod, thereby imparting closing force to the movable contact by means of a cam 16 rotatable about a main shaft 15 against the opening force due to the opening spring.

The operation of the vacuum switch shown in FIG. 2 is as follows.

In the case where the movable contact 6 is positioned at the position shown by solid lines, when the cam 16 is rotated in the anticlockwise direction so that the high point A of the cam will reach the position for contacting lower end of the movable rod 5, the rod will be forced upwardly and the movable contact 6 is also moved to engage the stationary contact 4 whereby current through a terminal and a current carrying conductor (not shown) passes through the contacts 4 and 6. When the cam 16 is further rotated in the same direction at the time of current interrupting, the movable contact 6 is separated from the stationary contact 4 by the opening force of the opening spring 12, but during the interval from the time when the intermediate point B engages the lower end of the rod 5 to the time when the point C comes to engage the rod 5, the movable contact 6 is not moved but maintained at the position separated a little from the stationary contact 4. This position of the contact 6 is shown dot and dash lines in FIG. 2 as an "interrupting opened position". When the cam 16 is further rotated to contact to the lower end of the rod 5 at the point D of the cam, the contact 6 takes the position shown by solid lines as "disconnecting opened position", and the movable contact 6 keeps this position as long as an instruction for carrying out the next closing operation is not given to operating means (not shown).

In general, when a vacuum switch is opened under a current conducting state, an electric arc is generated between the movable and stationary contacts, and the arc is extinguished at zero current state thereby interrupting the current. On the other hand, the vacuum switch according to this invention is operated by operating means so that the movable contact will be maintained at the "interrupting opened position" during at least the time when the arc is maintained between the contacts 4 and 6. Therefore, since metal vapor due to the arc deposits and condenses on the metal wall 9 of the reentrant portion 40, the vapor will not condense on the inner wall of the insulating cylinder 1 and the insulating strength thereof is not lowered. After the extinction of the arc, the movable contact is moved to the "disconnecting opened position" and ceases its opening operation. In this state, the stationary contact is supported in the reentrant portion 40 of the end plate 2 and the movable contact 6 has been moved into the reentrant portion 60 of the end plate 2' thereby alleviating the electric field near the surfaces of the contacts 4 and 6. Therefore, even if these surfaces are roughened by the arc, any spark over would not occur across the contacts 4 and 6 and the desirable insulating strength would be kept by the projected portions 10 and 11 of the end plates 2 and 2' which are never roughened by the arc.

Thus, according to this invention, it becomes possible to remove such defect as that the insulating strength between the movable and the stationary contacts is lowered by the roughening of the surfaces of the contacts due to the electric arc at the time of the current interruption.

Furthermore, even if the distance between the fully opened contacts is increased to increase the insulating strength, the interrupting capability would not be lowered because the current interruption is carried out at the "interrupting opened position" where the movable contact is not yet so greatly separated from the stationary contact.

It has been desired to permit an operator to visually observe the opened state of the contacts for the maintenance and the inspection of the vacuum switch. To this end, in the vacuum switch of this invention, the insulating cylinder 1 may be made of transparent glass so as to enable to directly observe the interior of the cylinder. Accordingly, in the closed state, the operator can confirm a part of the movable rod 5 in the gap between the projected portions 10 and 11, but in the fully opened state the operator cannot observe it. Thus, the operator can safely accomplish the maintenance and the inspection of the vacuum switch. Furthermore, in case of a bad vacuum condition, the light of glow discharge can be seen through the gap.

Figure 3:
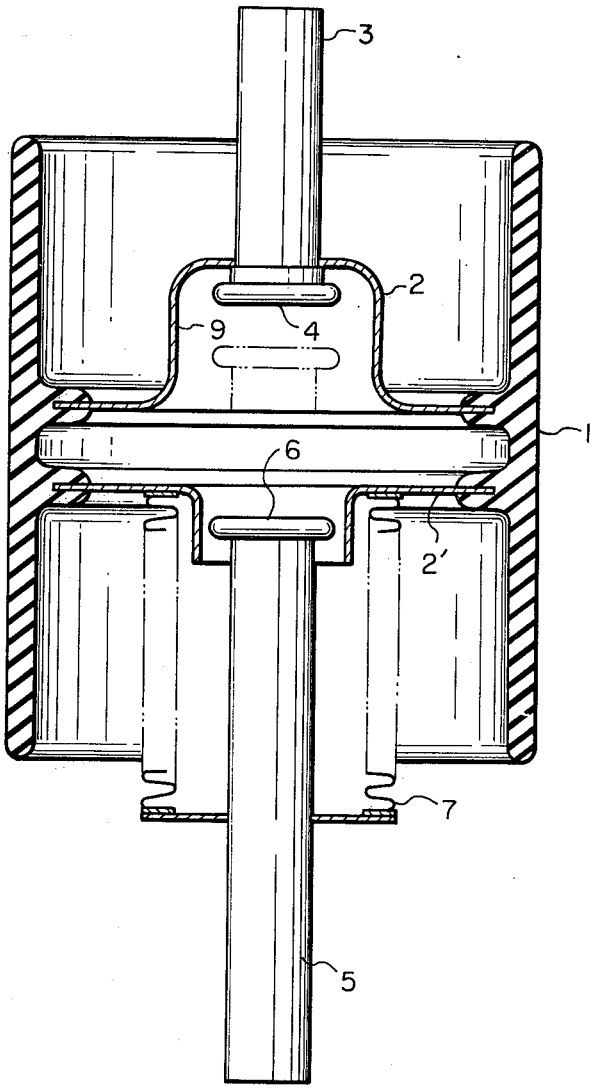
FIGS. 3 and 4 are vertical cross-sectionals views showing the other modified embodiments of this invention.

FIG. 3 shows another embodiment of this invention, in which the end plates 2 and 2' are sealed to the intermediate point of the inside wall of the insulating cylinder 1 thereby increasing considerably the external insulating strength than the embodiment shown in FIG. 2 in which the end plates 2 and 2' are sealed to the both ends of the insulating cylinder 1.

Figure 4:
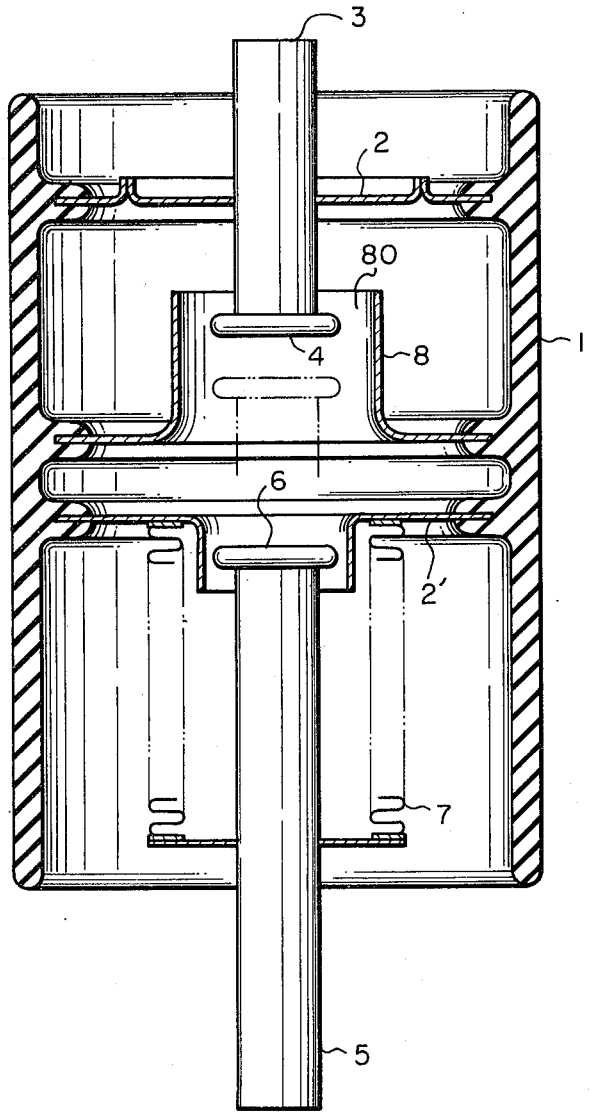

FIG. 4 is the other embodiment of this invention, in which the stationary contact 4 is not surrounded by the end plate 2, but by a cylindrical metal wall 8 having a horizontal flange sealed to the inside surface of the insulating cylinder 1 and the "interrupting opened position" is formed within the cylindrical metal wall as shown by dot and dash lines. The metal wall 8 is insulated from the movable and the stationary contacts and has a potential intermediate of the potential across both contacts. The wall 8 further defines an opened reentrant portion 80 in which the stationary and the movable contacts are positioned at the "interrupting opened position". In this embodiment, the end plate 2 supporting the stationary contact is attached to the portion different from the portion in the former embodiments, but the end plate 2' is attached to the inside surface of the cylinder 1 at an intermediate point thereof. The vacuum switch of such construction is useful for high voltage circuits.

Figure 5:
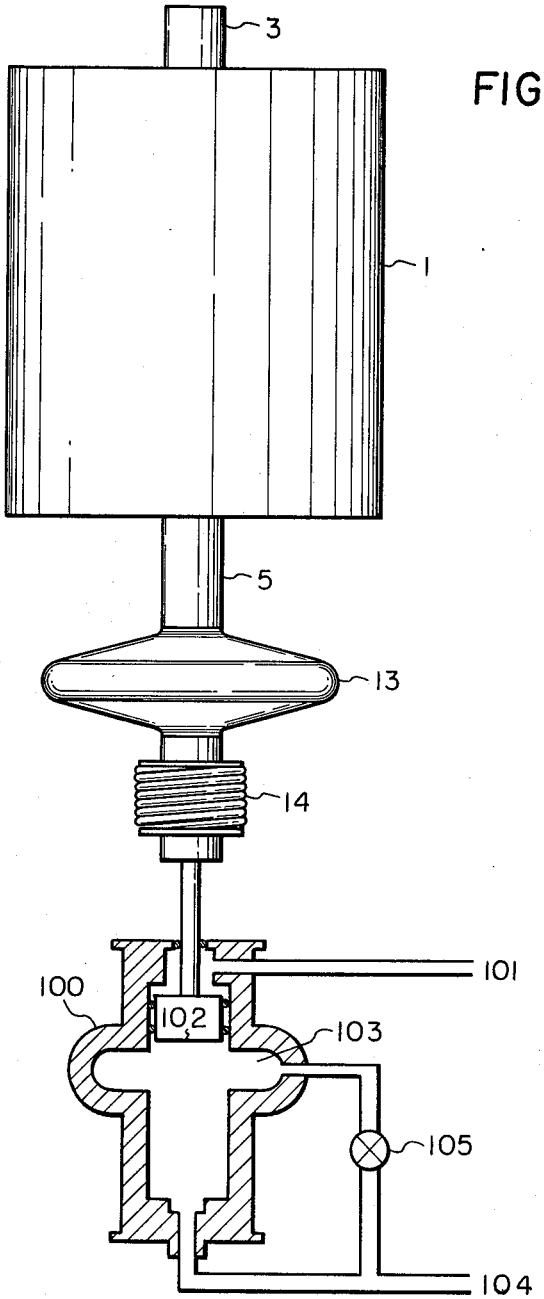
FIG. 5 is a vertical cross sectional view showing one example of an operating device for the vacuum switch of this invention.

FIG. 5 shows a case where the vacuum switch of this invention is operated by means of fluid pressure, such as hydraulic or pneumatic pressure. In this case, when fluid is fed through an inlet pipe 101, a piston 102 is lowered so that the movable contact will begin to separate from the stationary contact, and when the movable contact reaches the "interrupting opened position", the piston 102 begins to enter into an enlarged portion 103 of a cylinder 100. In this portion 103 since the volume of the cylinder is enlarged, the lowering speed of the piston is temporarily reduced, and when the enlarged portion is filled with the fluid under high pressure, the piston is again lowered to the bottom of the cylinder 100. Thus, the piston 102 stops at the bottom of the cylinder and then, movable contact takes the "disconnecting opened position".

To close the switch the fluid is fed through the other inlet pipe 104, and then if a valve 105 has been opened in advance to fill the enlarged portion 103 of the cylinder 100 with the fluid, the movable contact 6 is closed smoothly without stopping on the way.

Figure 6:
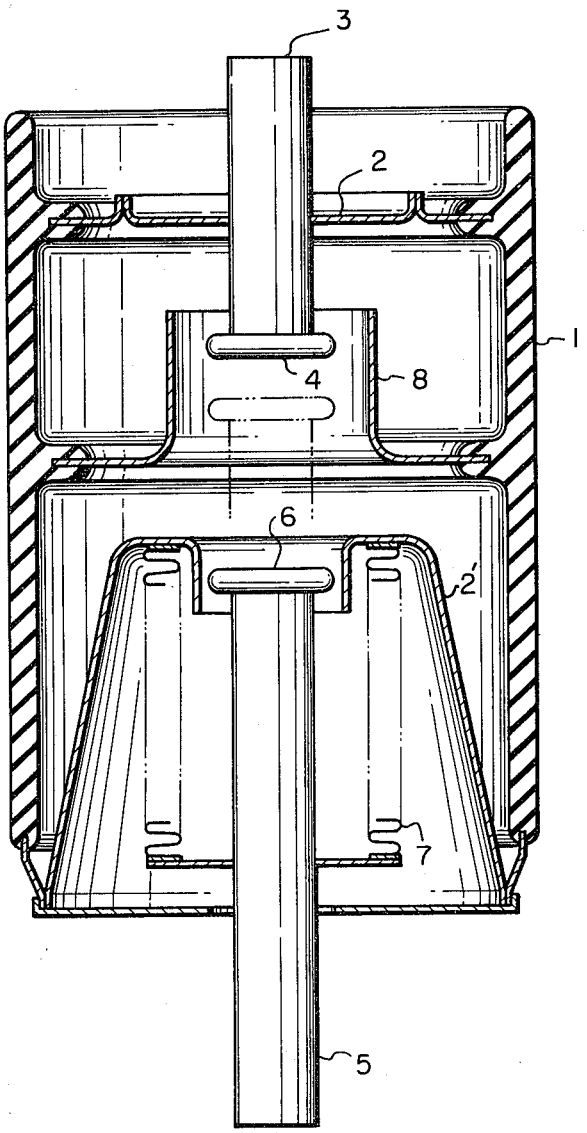
FIGS. 6 and 7 are vertical cross-sectional views showing further embodiments of this invention.
Figure 7:
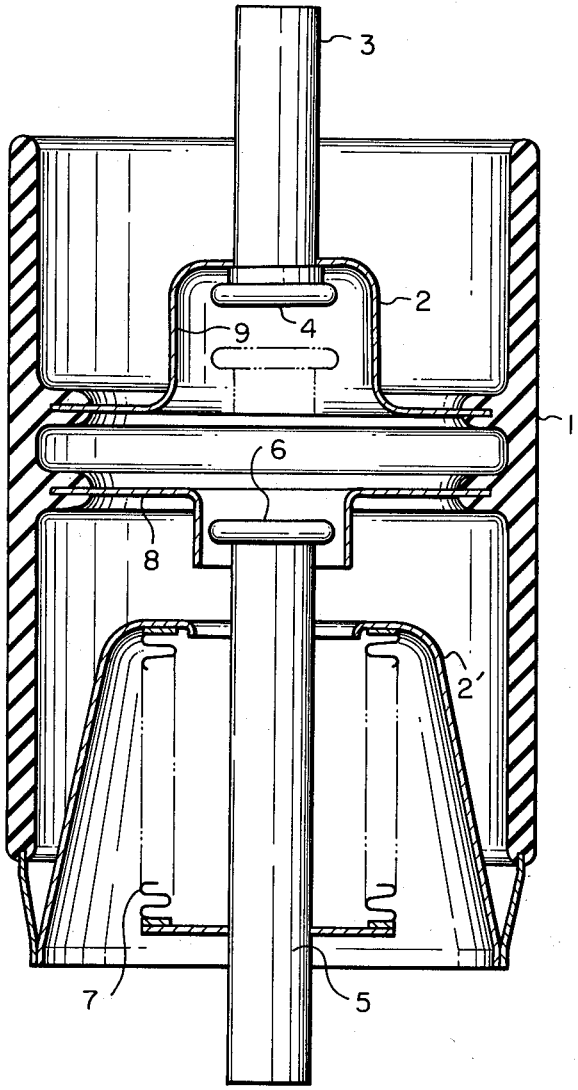

FIG. 6 shows a further embodiment of the vacuum switch of this invention, in which the stationary contact side has the same construction as that shown in FIG. 4 and the movable contact side has the same construction as that shown in FIG. 2, and in FIG. 7, the movable contact 6 is movable within the cylindrical metal wall 8 having a potential intermediate of the potential between the stationary and the movable contacts.

Figure 8:
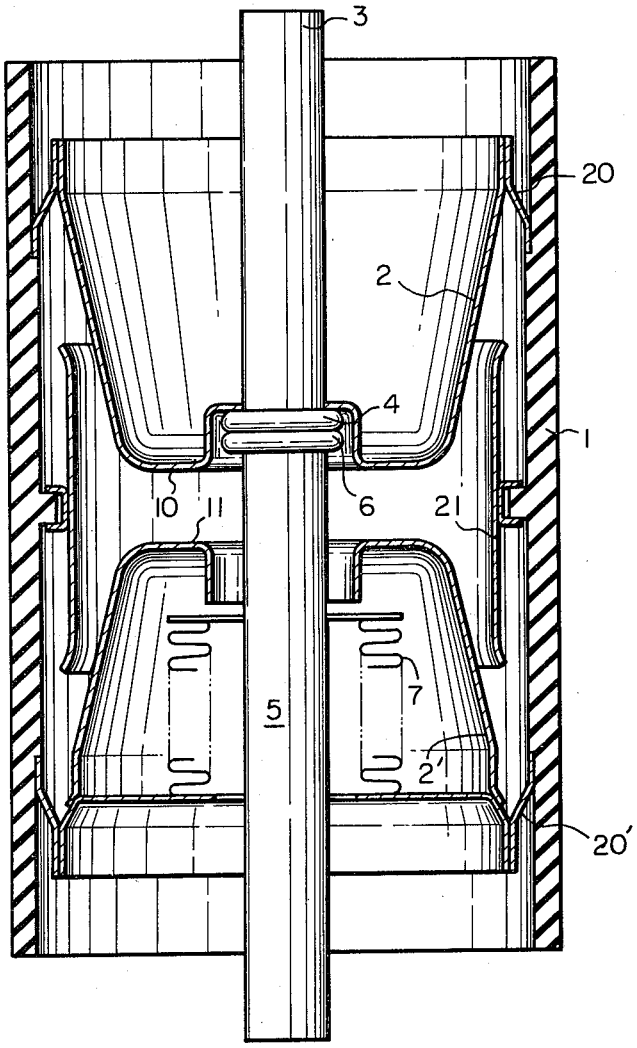
FIG. 8 is a cross-sectional view of a vacuum switch of this invention, in which annular metal fittings secured to end plates are attached to the inside wall of the insulating cylinder of the vacuum vessel.

FIG. 8 shows still further embodiment of this invention, in which annular metal fittings 20 and 20' are welded or soldered air-tightly at respective one end to the inside wall of the insulating cylinder 1 and secured at the other end to each end of the end plates 2 and 2', respectively. The both ends of the cylinder 1 extend outwardly beyond the end portions of the fittings so that fittings are not exposed to the outside of the insulating cylinder 1.

Figure 9A:
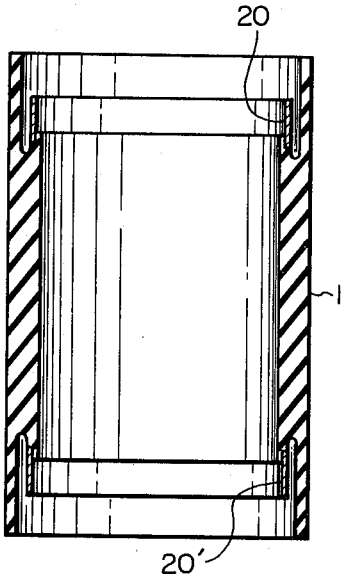
FIGS. 9*a* through 9*c* show modifications of FIG. 8.
Figure 9B:
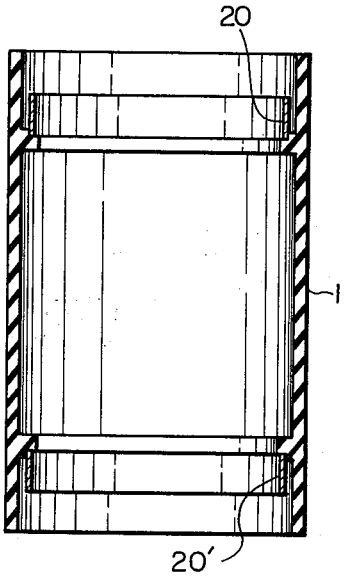
Figure 9C:
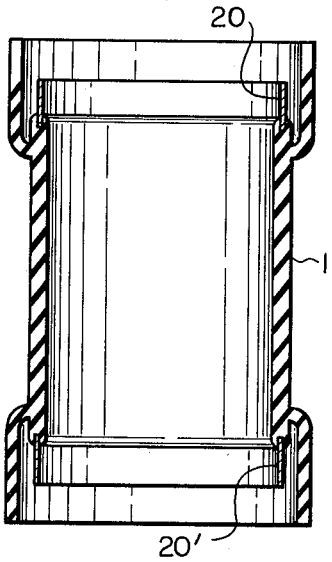

FIGS. 9*a* through 9*c* are the other embodiments of the attachment of the annular metal fittings 20 and 20' of FIG. 8.

Figure 10:
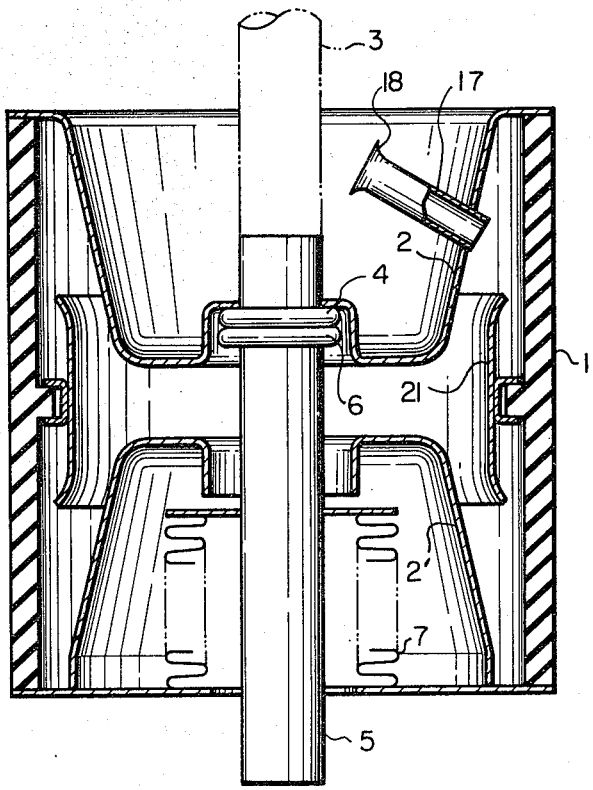
FIG. 10 is a vertical cross-sectional view showing still another embodiment of this invention, in which an evacuating and seal-off tube is provided.

FIG. 10 shows a further embodiment of the vacuum switch, in which an evacuating and seal-off tube 17 is provided for the end plate 2 or 2' so as not to project beyond the end of the insulating cylinder 1.

In the embodiments shown in FIGS. 8 and 10, an electrostatic shield 21 is provided to surround the end plates 2 and 2' for controlling the distribution of electric field between these end plates.

As is apparent from the foregoings, in the vacuum switch according to this invention, since the stationary and the movable contacts are positioned in the reentrant portion formed in one metal plate at the time of the current interruption and after the current interruption the movable contact is moved into the other reentrant portion of another metal plate insulated electrically from the former metal plate, superior interrupting capability having no reduced insulating strength can be obtained even if the surface of the contacts are roughened by electric arc.

Since annular metal fittings 20 and 20' are surrounded as shown in FIG. 8 by the insulating cylinder 1, the electric field is alleviated whereby the interphase insulating distance of a three phase circuit breaker and the insulating distance from the ground are considerably shortened. Therefore, a small and compact vacuum switch can be provided.

Furthermore, since the evacuating and seal-off tube 17 is provided for the end plate folded back inwardly of the insulating cylinder 1 so that the top end 18 of the tube 17 does not project beyond the end of the insulating cylinder 1, it is not damaged during the installation and conveyance of the vacuum switch.

Further it is to be understood by those skilled in the art that the foregoing description refers to preferred embodiments of this invention and that various modifications and changes can be made without departing from the scope and spirit of the invention as defined in the appended claims.

We claim:

1. In a vacuum switch comprising a vacuum vessel having an insulating cylinder and end plates which are air-tightly sealed to both ends of said insulating cylinder, relatively movable first and second contacts, and a bellows attached to one of said end plates, the improvement which comprises a first metal plate having a first annular edge portion and a relatively long first cylindrical reentrant portion extending from the inner end of said first edge portion in parallel with said insulating cylinder, a second metal plate having a second annular edge portion opposed to said first edge portion and a second cylindrical reentrant portion extending from the inner end of said second edge portion in parallel with said insulating cylinder, said second reentrant portion being coaxial with said first reentrant portion, said first and second edge portions being disposed in parallel with a predetermined spacing therebetween, and means for separating said contacts such that said contacts are firstly separated in said first reentrant portion of said first metal plate at the time of current interruption and that one of said contacts is then moved into the second cylindrical reentrant portion of said second metal plate for increasing the insulating distance after the current interruption.

2. The vacuum switch according to claim 1, wherein said first metal plate comprises one of said end plates, supporting one of said contacts, said end plate extending inwardly at an angle with respect to said insulating cylinder and bent horizontally near the central portion of said vacuum vessel to form a flat portion, and further bent backwardly to form said first reentrant portion having a relatively long cylindrical wall parallel to said insulating cylinder, said flat portion being disposed in parallel with said second edge portion of said second metal plate with a predetermined spacing therebetween.

3. The vacuum switch according to claim 1, wherein said first metal plate comprises a metal plate secured to the inner surface of said insulating cylinder and having a potential intermediate the potential across said contacts.

4. The vacuum switch according to claim 1, wherein said second metal plate comprises the other of said end plates.

5. The vacuum switch according to claim 1, wherein said second metal plate comprises a metal plate secured to the inner surface of said insulating cylinder and having a potential intermediate the potential across said contacts.

6. The vacuum switch according to claim 1, wherein at least one of said end plates is connected to said insulating cylinder through an annular metal fitting, said annular metal fitting being secured airtightly to the end surface of said end plate at its one end and sealed to the inner surface of said insulating cylinder at its other end in a manner that the end of said insulating cylinder will surround and extend beyond the end of said annular metal fitting.

* * * * *